United States Patent [19]

Fuller

[11] 4,026,178

[45] May 31, 1977

[54] MAGNETIC PICKUP FOR STRINGED MUSICAL INSTRUMENT

[75] Inventor: Walter Leonard Fuller, Kalamazoo, Mich.

[73] Assignee: Norlin Music, Inc., Lincolnwood, Ill.

[22] Filed: Apr. 11, 1975

[21] Appl. No.: 567,290

[52] U.S. Cl. ..... 84/1.16; 84/1.15

[51] Int. Cl.[2] ..... G10H 3/00

[58] Field of Search ..... 84/1.01, 1.14, 1.15, 84/1.16

[56] References Cited

UNITED STATES PATENTS

| | | | |
|---|---|---|---|
| 2,310,606 | 2/1943 | Barth | 84/1.16 |
| 2,327,277 | 8/1943 | Lovell | 84/1.15 |
| 2,896,491 | 7/1959 | Lover | 84/1.16 |
| 3,066,567 | 12/1962 | Kelley | 84/1.15 |
| 3,236,930 | 2/1966 | Fender | 84/1.15 |
| 3,249,677 | 5/1966 | Burns et al. | 84/1.15 |
| 3,571,483 | 3/1971 | Davidson | 84/1.16 |
| 3,715,446 | 2/1973 | Kosinski | 84/1.15 |

*Primary Examiner*—Robert K. Schaefer
*Assistant Examiner*—Vit W. Miska
*Attorney, Agent, or Firm*—Hill, Gross, Simpson, Van Santen, Steadman, Chiara & Simpson

[57] ABSTRACT

A magnetic pickup for a stringed instrument has one or two coils juxtaposed with the strings each coil having an inner polepiece disposed centrally therein. A single polarity is induced in each inner polepiece by two bar magnets, one at each side of the polepiece externally of the coil. An outer polepiece is magnetically coupled to an outside edge of each of the bar magnets and extends toward the strings. Each polepiece has a preselected shape, with an upper edge which is either continuous, or discontinuous with a plurality of pole legs, one common to each string of the musical instrument. The distance between the pickup and strings is adjustable to select a desired response. When pole legs are used, they are selectable in height by shearing off the distal end of each leg to obtain a selected pickup sensitivity for each string.

16 Claims, 11 Drawing Figures

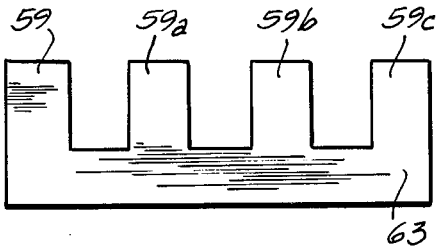
Fig. 6
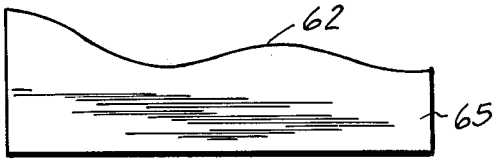
Fig. 8
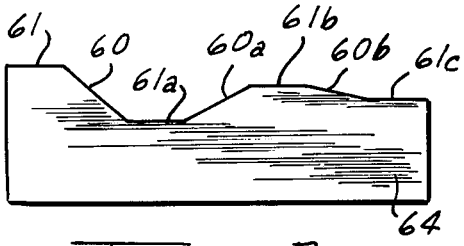
Fig. 7
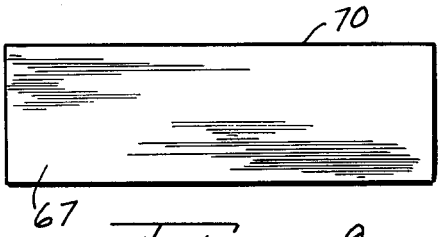
Fig. 9
Fig. 10
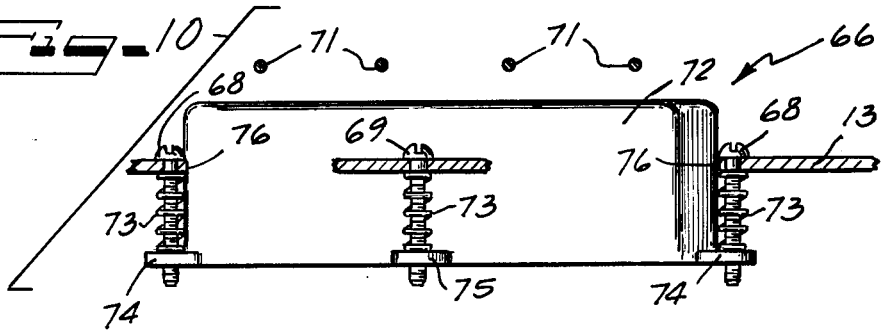
Fig. 11
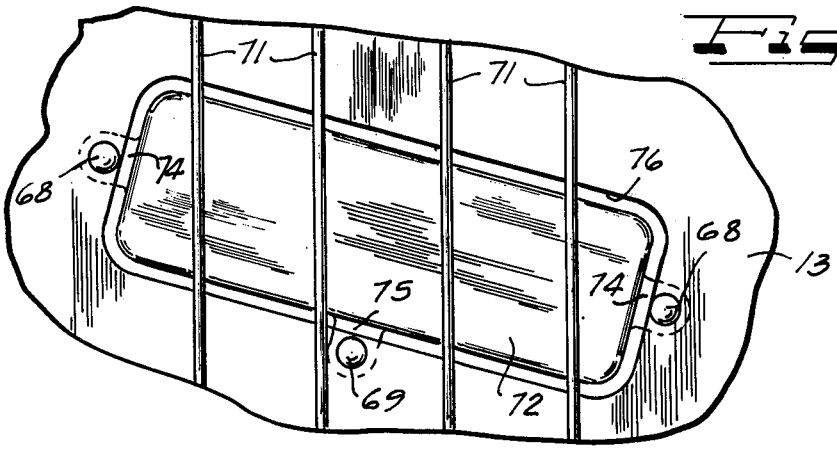

MAGNETIC PICKUP FOR STRINGED MUSICAL INSTRUMENT

BACKGROUND OF THE INVENTION

1. Field of the Invention

This invention relates to magnetic pickups for stringed musical instruments.

2. Prior Art

One-coil or two-coil magnetic pickups have been utilized for transducing the vibration of strings in musical instruments to corresponding electrical signals.

In a single-coil magnetic pickup, a coil wound around a permanent magnet core has electric currents induced therein when a string passing in proximity to the core vibrates. The vibration of the string varies the magnetic field through the core to induce a corresponding electric current. A separate permanent magnet is provided for each string, with the coil being common to all cores.

Single-coil pickups are susceptible to stray magnetic fields which cause hum or other noise. To eliminate the hum, an added coil has been serially connected out of phase. The stray fields generate equal and opposing currents which cancel each other. U.S. Pat. No. 2,896,491 to Lover describes the two-coil system in detail.

In either the one-coil or two-coil system, the pickup sensitivity for each string can be altered by providing ferromagnetic screws in the magnetic cores which are adjustable in order to adjust the height of the cores.

Prior pickups have low power output due to high flux path impedances. Therefore, substantial amplification of the pickup output is necessary. Prior designs also have a relatively low signal to noise ratio.

The prior magnetic pickups are also expensive to manufacture since individual polepieces or cores must be produced, assembled and adjusted for each string and each coil. Further, screw-type adjustments may be accidentally altered.

SUMMARY OF THE INVENTION

A magnetic pickup which is simple to manufacture yet has the feature of high output and sensitivity selection for each string is provided with individual sections of inner and outer polepieces, extending toward the strings and having an edge which is either continuous or discontinuous with a plurality of pole legs extending toward the strings. Pole legs on the outer polepieces are selectable in height by shearing distal ends of selected pole legs to change pickup sensitivity. Magnets couple the outer polepieces to the inner polepieces disposed in coils. These magnets have like poles positioned in contact with opposite sides of the inner polepieces. The thickness of each inner polepiece is sufficient to overcome repelling between the like poles.

The outer polepieces reduce the flux path impedance by providing a return path for magnetic flux. The pole legs on the outer polepiece also serve to concentrate the flux coupled in each string.

A method of selecting the heights of the individual sections of the polepiece comprises forming the inner and outer polepiece means as flat structures with a preselected height for each string and, when pole legs are employed, shearing the distal ends of the outer polepiece pole legs.

It is an object of this invention to provide a magnetic pickup having a high output.

It is an object of this invention to provide a magnetic pickup and a method for making the same in which production costs are reduced by simplifying tooling and assembly.

It is a further object of this invention to provide tamper-proof sensitivity selections for each string.

It is another object of this invention to provide a set of sensitivity selections which can be standardized for a particular product model.

It is yet another object of this invention to enable a set of professionally chosen sensitivity selections which may be incorporated into a magnetic pickup during production.

It is another object of this invention to simplify the method of manufacturing magnetic pickups.

ON THE DRAWINGS

FIGS. 6, 7, 8, and 9 are side views of alternate embodiments for polepieces of the invention;

FIG. 10 is a side view of a magnetic pickup of the invention with adjusting screws; and FIG. 11 is a top view of a magnetic pickup of this invention with adjusting screws.

AS SHOWN ON THE DRAWINGS

Figure 1:
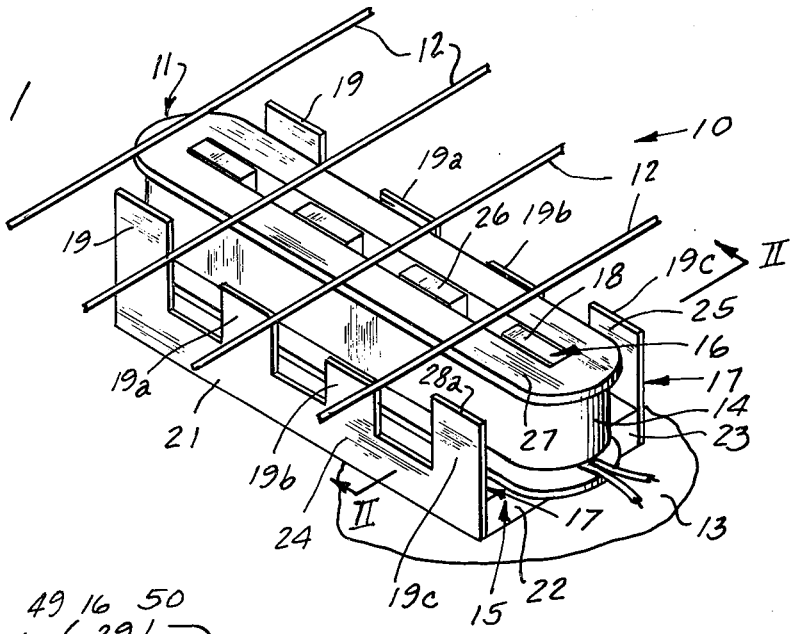
FIG. 1 is a perspective view of a magnetic pickup provided in accordance with an illustrative embodiment of the invention, a cover being omitted.

The principles of the present invention are particularly useful when embodied in a stringed musical instrument as shown in FIG. 1 generally indicated by the numeral 10.

A magnetic pickup 11 is positioned beneath a set of strings 12 and is fastened to an instrument surface 13.

The magnetic pickup 11 has a coil means 14 positioned at one side of a magnet means 15. An inner and an outer ferromagnetic polepiece means 16, 17 are provided having a comb-like configuration, the teeth of which are a plurality of pole legs 18 and 19 respectively. The inner ferromagnetic polepiece means 16 is a single polepiece disposed within the coil means 14 and has an end 20, shown in FIG. 2, which projects beyond the coil means 14. The magnet means 15 is magnetically coupled to the end 20 to create a single polarity in the inner polepiece means 16. The outer polepiece means 17 has a remote portion 21 remote from the pole legs 19 which magnetically couple with the magnet means 15.

The magnet means 15 comprises a pair of magnets 22 and 23 which have poles of like polarity positioned in contact with opposite sides of the inner polepiece means 16. A possible repelling effect between like poles is minimized by having sufficient thickness of the inner polepiece means 16.

The outer polepiece means 17 comprises two outer polepieces 24 and 25 on opposite sides of the coil means 14 and respectively coupled to the magnets 22 and 23. Each of the outer polepieces is less than half the thickness of the inner polepiece means 16 and preferably are one-fourth such thickness.

The pole legs 18 on the inner polepiece means 16 are of equal height in the illustrated embodiment and each has a distal rectangular end face 26 which is level with an end 27 of the coil means 14. However, these end faces may also have height variances below or above the end 27 of the coil means.

Each pole leg 19 on the outer polepiece means 17 has a rectangular distal end 28*a* of selected height. Each pole leg on the polepiece 24 has an individually preselected height. In the illustrated embodiment, each is a different height with pole legs common to one of the strings 12 being the same height. The difference in heights compensates for variations in string height and other characteristics and the exact height of the legs will depend on these factors.

In another embodiment of the invention, some or all of the pole legs on the outer polepieces 24, 25 are of the same height, as illustrated in FIG. 6.

Four strings 12 are provided in the musical instrument 10. A set of the pole legs 18 and 19 is provided for each string.

Figure 2:
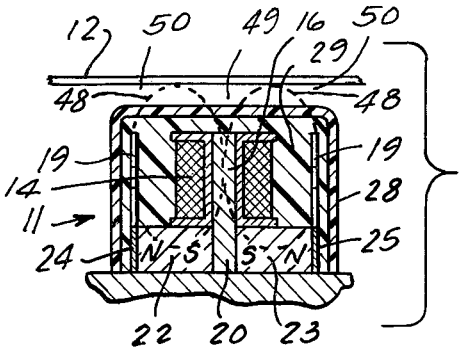
FIG. 2 is a cross-sectional view taken along line II—II of FIG. 1.

As shown in FIG. 2, a close fitting plastic cap 28 encloses the structure described. The parts beneath the plastic cap 28 are potted with an epoxy resin compound 29 which holds the components together.

The polarities of the magnets 22 and 23 are indicated in FIG. 2 with like south poles coupled to opposite sides of the single inner polepiece 16 to create a single polarity therein. North poles of the magnets 22 and 23 are coupled to the outer polepieces 24 and 25 and induce polarities in pole legs 19 which are opposite to the polarity of the inner polepiece 16.

Figure 3:
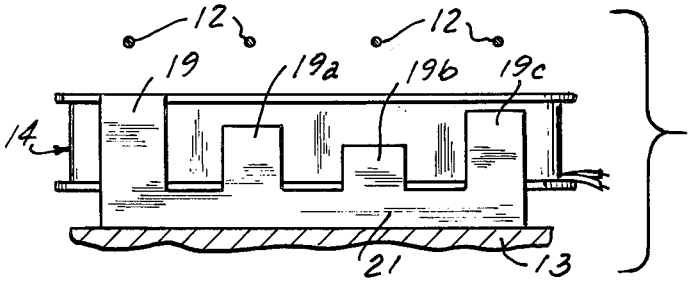
FIG. 3 is a side elevational view of the magnetic pickup of FIG. 1.

As shown in FIG. 3, the position of each of the strings 12 over each of the pole legs 18 is approximately centered. The differing heights between each of the strings 12 and the respective pole legs 19 beneath the strings varies depending upon the selection of height for each pole leg.

The magnetic pickup 11 has signals induced in the coil 14 by vibration of the strings 12. Two symmetrical magnetic circuits each having flux lines 48 are formed. The flux lines 48 pass from the single inner polepiece 16 and one of its pole legs 18 through an air gap 49 into one of the strings 12. The flux lines flow along the string in both directions toward the outer pole legs 19 where the flux lines 48 enter second air gaps 50 and pass into the pole legs 19 and the outer polepieces 24 and 25. The magnets 22 and 23 complete the circuit by transferring the flux from the outer polepieces 24 and 25 to the single inner polepiece 16.

The outer polepieces 24 and 25 provide a low impedance path for flux lines 48 leaving strings 12 and returning to inner polepiece 16. In addition, where pole legs 19 are formed on the outer polepieces, the flux lines are concentrated in the area of the strings, thus improving output.

As distal end faces 28 are sheared or clipped to a selected height, the air gap 50 increases magnetic circuit resistance to lower induced signal amplitude in the coil 14.

The polepieces 24, 25, 30 are each manufactured as flat comb-like structures by stamping from ferromagnetic sheets. The same punch and die can be used for all the polepieces. A selected amount is then removed from one or more of the pole legs 19 (as shown at 19*a*, 19*b* and 19*c*) of the outer polepieces 24 and 25 to reduce their effectiveness and thus for selection of predetermined string sensitivities. Different sets of sensitivities may be used for various production models.

Figure 4:
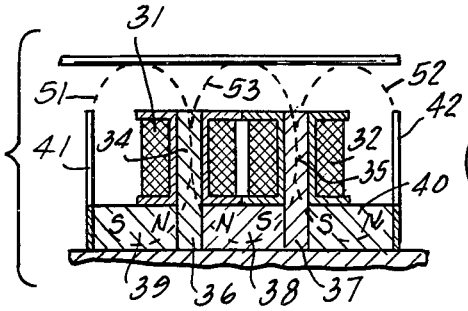
FIG. 4 is a cross-sectional view of a second embodiment of this invention taken along a line similar to line II—II in FIG. 1.

A second embodiment of the invention is shown in FIG. 4, in which the coil means comprises two coils 31 and 32. These coils 31, 32 are connected in series and out of phase.

The inner polepiece means comprises two inner polepieces 34 and 35 respectively disposed in the coils 31 and 32. Their ends 36 and 37 project beyond the respective coils and have magnet means coupled thereto comprising an inner magnet 38 and two outer magnets 39 and 40. The inner magnet 38 magnetically couples the magnet ends 36 and 37. The outer magnets 39 and 40 are magnetically coupled to the inner polepieces 34 and 35 respectively. A pair of outer polepieces 41 and 42 are respectively coupled to the outer magnets 39 and 40.

Poles of the magnets 38, 39 and 40 are positioned to create opposite polarities between the inner polepieces 34 and 35. Polarities in the outer polepieces 41 and 42 are opposite to one another and opposite to the nearest respective inner polepiece 34 or 35. The magnets 38–40 are arranged so that the polepieces have successive polarities S, N, S and N.

Operation is similar to the first embodiment except three magnetic circuits are formed. Flux lines 51 form one magnetic circuit between the outer polepiece 41 and the inner polepiece 34. A similar circuit is formed by flux lines 52 between the outer polepiece 42 and the inner polepiece 35. A central magnetic circuit is formed by flux lines 53 between the inner polepieces 34 and 35.

Figure 5:
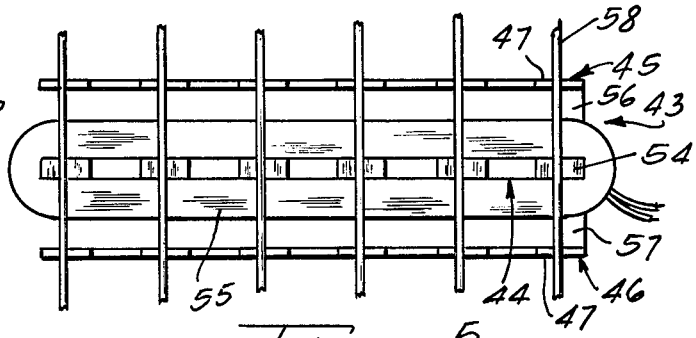
FIG. 5 is a top view of a third embodiment.

FIG. 5 represents another embodiment of the invention illustrating a six-string magnetic pickup 43. Each of the polepieces 44, 45 and 46 has six pole legs 47, 54. The pickup 43 further includes coil means formed as a single coil 55, magnet means formed as a pair of permanent magnets 56, 57 whereby the pickup 43 coacts with a set of six strings 58 for operation as described for the species of FIGS. 1 and 2, including pole height selection.

FIGS. 6, 7, 8, and 9 illustrate alternate shapes for the outer and inner polepieces.

In FIG. 6, a polepiece 63 having pole legs 59, 59*a*, 59*b*, and 59*c* of equal height is illustrated.

FIG. 7 illustrates a polepiece 64 having a segmented surface formed by flat cuts 61, 61*a*, 61*b*, 61*c* and angle cuts 60, 60*a*, 60*b* in place of the pole legs of previous embodiments. The flat cuts are made at preselected levels below the instrument strings, with the angle cuts serving as a continuous transition between levels.

FIG. 8 illustrates a polepiece 65 having a curved surface 62 in place of pole legs. The shape of the surface is chosen to select a desired combination of string sensitivities.

FIG. 9 illustrates a polepiece 67 with a rectangular shape and having a flat surface 70 which is positioned below the instrument strings.

FIGS. 10 and 11 illustrate a magnetic pickup 66 of this invention with a case 72 mounted in a cut out 76 of the instrument surface 13. Adjusting screws 68 and 69 mounted at tabs 74 and 75 respectively provide height and tilt adjustment of the case 72 to which these tabs are mounted. Springs 73 are mounted around the screws 68, 69 and between the instrument surface 13 and tabs 74, 75. These springs stabilize the case 72 by providing tension at the screw mountings.

By tilting and adjusting height of the pickup 66 the sensitivity and overall response of the pickup to the string vibrations may be adjusted.

To achieve desired pickup response, pickup 66 may be mounted at various angles to the strings 71 as shown in FIG. 11.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A magnetic pickup for a musical instrument having a plurality of strings, comprising:

a. a coil common to said strings;

b. an inner ferromagnetic polepiece common to said strings and partially disposed in said coil;

c. magnet means common to said strings and magnetically coupled to said inner polepiece and inducing a single polarity in said inner polepiece; and d. at least one flat outer ferromagnetic polepiece magnetically coupled to the magnet means outside of said coil and having a polarity opposite to that of the nearest portion of said inner polepiece.

2. A magnetic pick-up according to claim 1 in which said inner polepiece has a plurality of pole legs integrally formed with each other, there being one pole leg for each string.

3. A magnetic pickup according to claim 1 in which said outer polepiece is common to said strings and has a uniform length and uniform height.

4. A magnetic pickup according to claim 1 in which said outer polepiece has a segmented surface below the instrument strings in the form of pole legs with a continuous transition from the upper end of one pole leg to the upper end of the next pole leg.

5. A magnetic pickup according to claim 1 in which the upper edge of said outer polepiece is a curved surface below the instrument strings extending transversely to their length.

6. A magnetic pickup according to claim 1 in which said magnet means comprises at least two magnets positioned on different sides of said inner polepiece and each magnet having oppositely directed poles facing in a direction parallel to the length of the strings.

7. A magnetic pickup according to claim 1 in which a case having three mounting tabs surrounds the pickup, said case being connected to the instrument by at least three adjusting screws for providing a height and tilt adjustment.

8. A magnetic pickup according to claim 1 in which said, inner polepiece has a uniform length and a uniform height.

9. A magnetic pickup according to claim 1 in which said inner polepiece is flat and is of uniform thickness.

10. A magnetic pickup according to claim 1, said coil comprising two coils connected in series out of phase relationship at one side of said magnet means, said inner polepiece comprising two of said inner polepieces respectively disposed in said two coils, and said magnet means comprising an inner and two outer magnets, the outer magnets being disposed outside said inner polepieces and said inner magnet being disposed between said inner polepieces.

11. A magnetic pickup according to claim 10 in which said outer polepiece comprises two of said outer polepieces respectively positioned in contact with each of said two outer magnets and having polarities opposite to each other.

12. A magnetic pickup according to claim 2 in which said outer polepiece has a plurality of pole legs of a height equal to that of said pole legs of said inner polepiece.

13. A magnetic pickup according to claim 12 in which the distal end of at least one pole leg has been removed to effect a fixed height different from at least one of the other pole legs.

14. A magnetic pickup for a musical instrument having stings, comprising:

a. a coil common to a plurality of the strings;

b. a flat inner ferromagnetic polepiece of uniform thickness common to said strings and partially disposed in the coil;

c. magnet means common to said strings and magnetically coupled to said inner polepiece and inducing a single polarity in said inner polepiece; and d. two flat separate outer ferromagnetic polepieces common to a plurality of the strings, each being magnetically coupled to said magnet means and disposed on opposite sides of said coil.

15. A magnetic pickup for a musical instrument having strings, comprising:

a. coil means common to a plurality of the strings;

b. a flat inner ferromagnetic polepiece of uniform thickness disposed in the coil and common to the plurality of the strings, said inner polepiece having a corresponding plurality of integral pole legs, there being one pole leg for each string and all said pole legs having the same height;

c. magnet means magnetically coupled to said inner pole-piece to induce a single polarity in each pole leg; and d. two flat separate outer ferromagnetic polepieces common to the plurality of strings, each being magnetically coupled to said magnet means and disposed on opposite sides of said coil means, said outer polepiece each having one pole leg per string and all of said outer polepiece pole legs having the same height

16. A magnetic pickup for a stringed musical instrument, having a plurality of ferromagnetic strings supported generally in a single plane in side by side relation, comprising:

a. a coil;

b. a flat permanent magnet juxtaposed with said coil for inducing magnetic flux within said coil and within a plurality of said strings; and c. a plurality of separate flat polepieces magnetically coupled with said permanent magnet and shaped to form a plurality of paths for magnetic flux through the turns of said coil, each of said paths including one of said strings, at least one of said polepieces being a thin flat sheet of ferromagnetic material juxtaposed with said permanent magnet and disposed in a plane generally normal to the plane of said strings, said sheet having an edge configuration spaced from each of said strings by a selected non uniform distance so that the length of the magnetic flux path through each of said string is individually determined in accordance with the shape of said edge.

* * * * *